United States Patent [19]

DuBois et al.

[11] 4,091,961

[45] May 30, 1978

[54] CHIME PROTECTIVE GASKET

[75] Inventors: Robert A. DuBois; Rex E. Wagers, both of Marion, Ohio

[73] Assignee: Greif Bros. Corporation, Delaware, Ohio

[21] Appl. No.: 698,114

[22] Filed: June 21, 1976

[51] Int. Cl.[2] ..... B65D 45/32; B65D 53/02

[52] U.S. Cl. ..... 220/319; 220/81; 220/378; 277/207 R; 277/208

[58] Field of Search ..... 220/319, 321, 320, 67, 220/80, 81 R, 378, 81; 277/213, 207 R, 208; 27/14, 17, 19; 229/5.7

[56] References Cited

U.S. PATENT DOCUMENTS

| | | | |
|---|---|---|---|
| 1,723,307 | 8/1929 | Sipe | 220/80 |
| 1,817,870 | 8/1931 | Bille | 277/207 A |
| 2,347,618 | 4/1944 | Tator | 220/81 R |
| 2,884,176 | 4/1959 | Carpenter et al. | 229/5.7 |
| 3,055,529 | 9/1962 | Cameron et al. | 220/378 |
| 3,065,517 | 11/1962 | Dower | 277/207 |
| 3,098,581 | 7/1963 | Marsilio | 220/320 |
| 3,187,974 | 6/1965 | Rodish | 229/5.7 |
| 3,400,954 | 9/1968 | Brown | 277/207 A |
| 3,443,735 | 5/1969 | Meijers | 229/5.7 |
| 3,790,020 | 2/1974 | Fine | 220/319 |

*Primary Examiner*—Stephen P. Garbe
*Assistant Examiner*—Allan N. Shoap
*Attorney, Agent, or Firm*—Kane, Dalsimer, Kane, Sullivan and Kurucz

[57] ABSTRACT

A protective gasket for the chime of a container. The gasket includes an annular flexible strip adapted to conform to surfaces of the chime. Surfaces on the strip cooperate with the container surfaces to hold the strip in position on the chime. Projecting ribs on the strip are located to engage with a cover applied to the container to provide a seal between the container and the lid.

9 Claims, 5 Drawing Figures

FIG.3
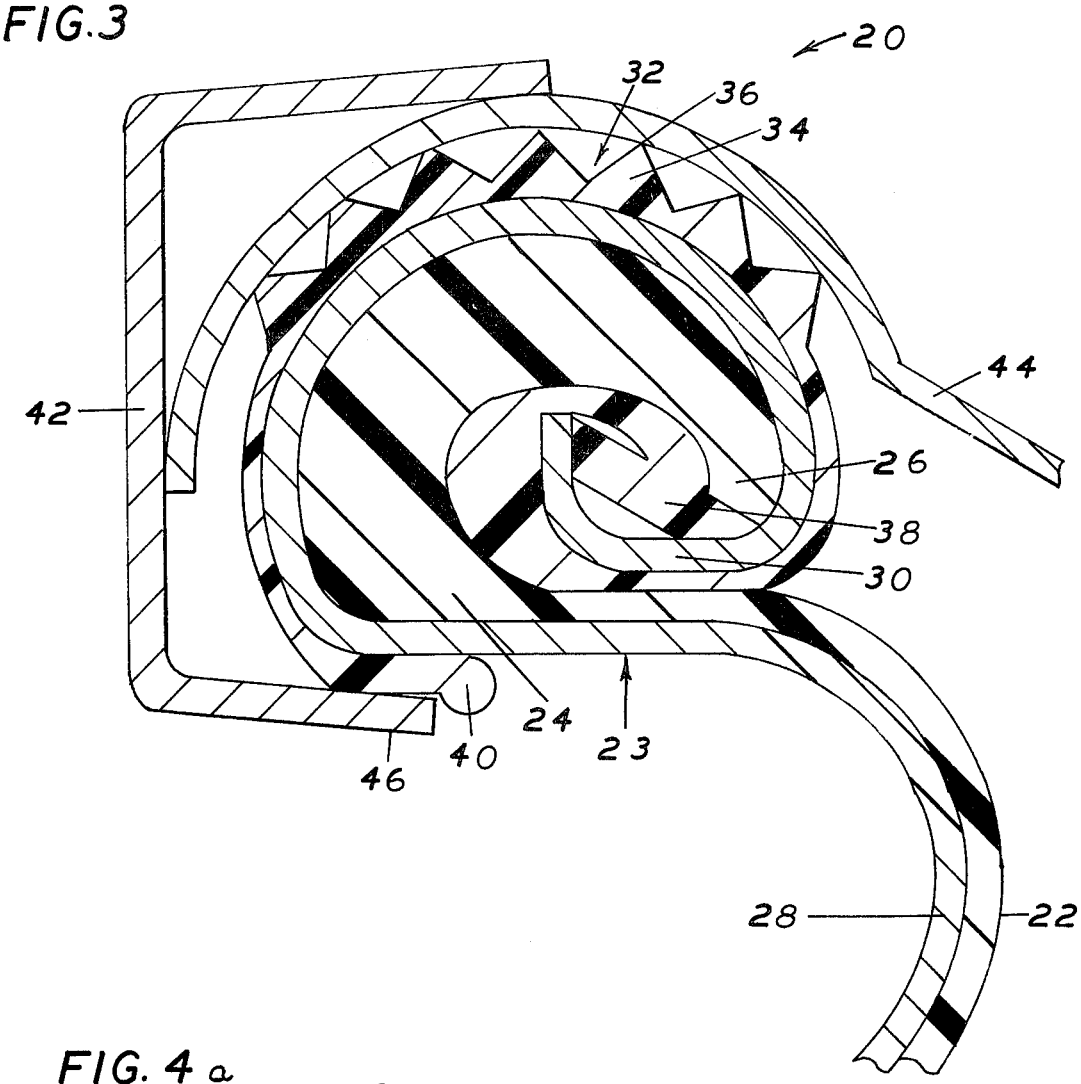
FIG. 4 a
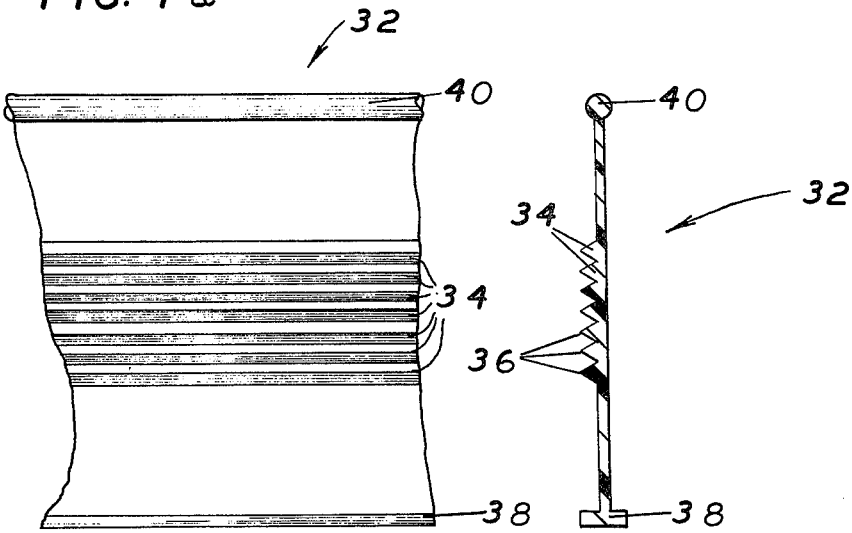
FIG. 4 b

CHIME PROTECTIVE GASKET

BACKGROUND OF THE INVENTION

In conventional and well known plastic, fiber and metal containers and drums, particularly of the industrial type, the tops are often provided with a chime construction having an inwardly formed bead. A chime strip surrounds the bead and conforms thereto and a lid and locking ring are utilized to cover the top of the container.

When liquids are stored it is often difficult to maintain a positive seal between the lid and the container even with the lid generally conforming to the shape of the bead on the top of the container. Accordingly, there exists a need for an effective sealing means between the top of the container and the lid to prevent leakage, and above all a seal that is inexpensive and one which can be readily and easily manufactured and applied to containers.

SUMMARY OF THE INVENTION

With the above background in mind, it is among the primary objectives of the present invention to provide a protective gasket which is designed for use with containers having a top chime structure and a beaded top rim and is inexpensive in nature and is useable with plastic, fiber, steel, lined as well as other containers and drums. The gasket is designed to be ultimately incorporated as part of the chime and container construction and retained in position thereon. Additionally, the gasket is designed with sealing surfaces to cooperate with a lid in providing a seal against fluid leakage when the lid is coupled with the container. The gasket structure includes surfaces which cooperate with surfaces of the container, the lid and a locking ring used to couple the lid to the container to maintain a positive seal and to be retained in fixed position on the container for prolonged periods of time.

In particular, the gasket is in the form of an annular plastic strip with longitudinal ribs extending outwardly therefrom intermediate the transverse edges. The ribs are in the form of triangular in section pointed flexible elements which will engage with the inner surface of the lid when the strip is positioned on the upper end of the container to form the seal. The strip is also provided with a flange on one transverse edge and a bead on the other transverse edge. The flange cooperates with surfaces of the container to assist in retaining the gasket in fixed protective position. The bead of the gasket cooperates in preventing leakage in the area of the chime surrounding the upper portion of the container including the bead on the upper rim thereof when a lid is coupled with the container.

In summary, the protective gasket is particularly adapted for use with the top chime construction of a container to assist in forming a seal between the beaded upper rim of the container. The gasket includes an annular flexible strip adapted to conform to the surface of the chime of the container and is provided with retention means for cooperating with surfaces on the container to hold the strip in position on the chime. Projecting ribs are on the strip for engaging with the lid applied to the container and to enhance the seal between the container and lid.

With the above objectives among others in mind, reference is made to the attached drawings.

BRIEF DESCRIPTION OF THE DRAWINGS

In The Drawings:

FIG. 3 is a sectional elevational view thereof; and

FIG. 4*a* is a fragmentary elevational view of the gasket.

FIG. 4*b* is a cross-section view of the gasket of 4*a*.

DESCRIPTION OF THE PREFERRED EMBODIMENT

Figure 1:
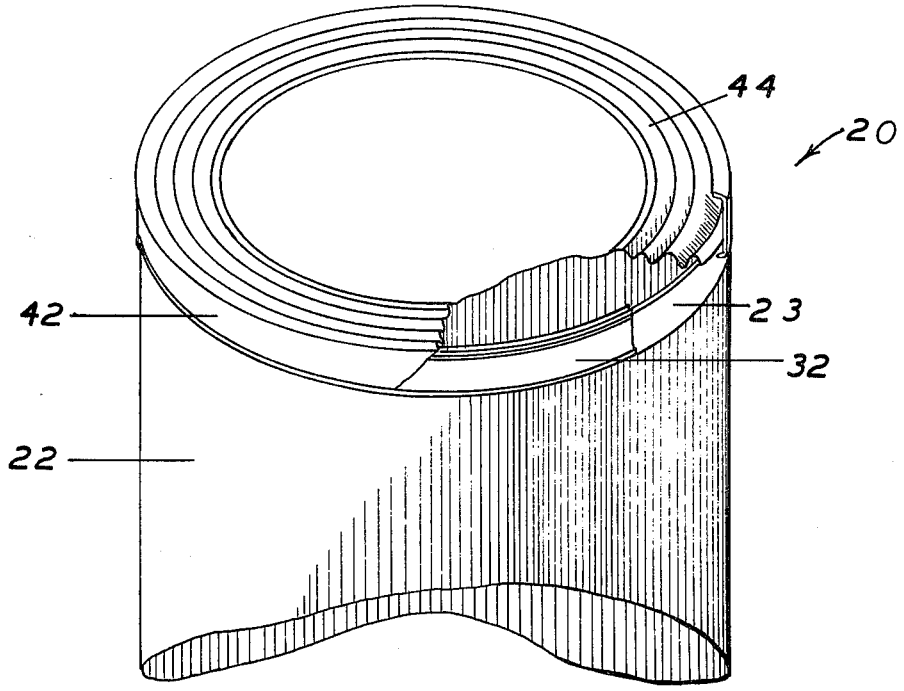
FIG. 1 is a fragmentary side elevation view of a container with a lid and locking ring applied thereto and a portion of the sealed container broken away to show the protective gasket in accordance with the invention.
Figure 2:
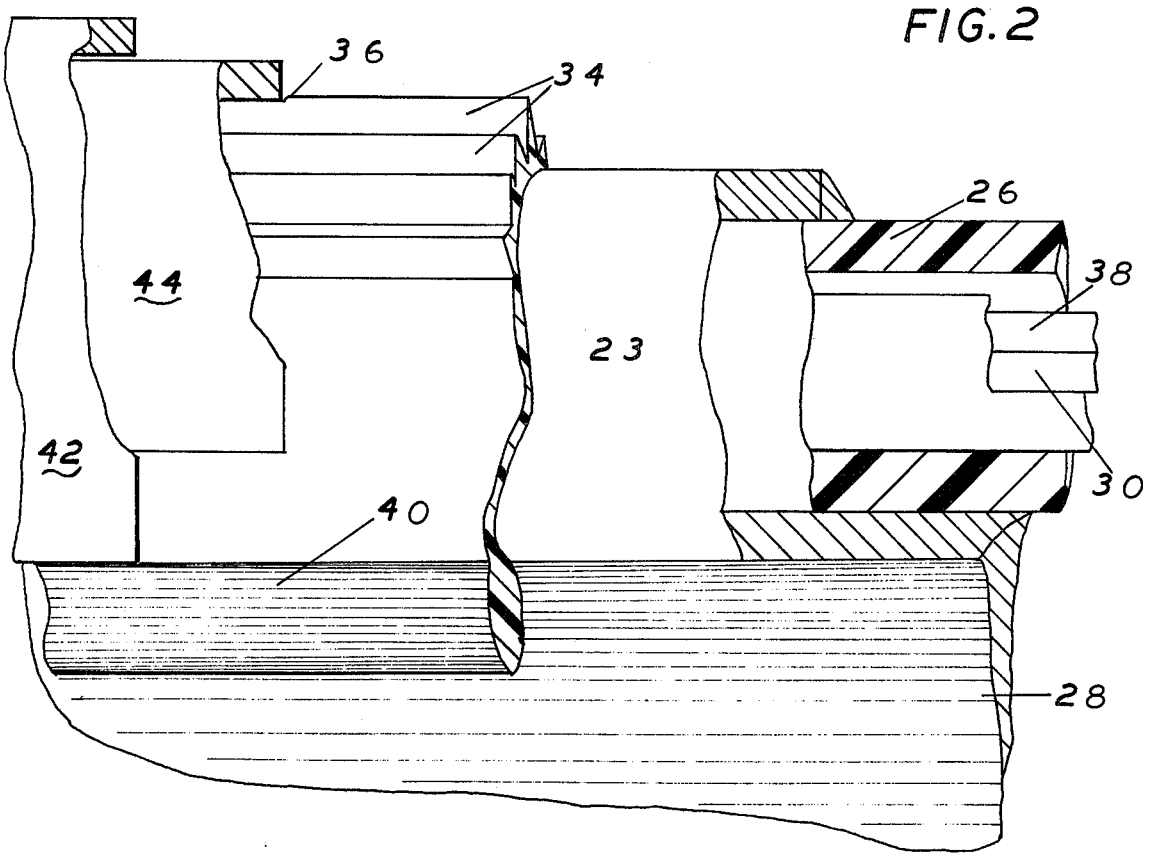
FIG. 2 is an enlarged fragmentary sectional view of the top chime construction incorporating the teachings of this invention.

FIGS. 1–3 of the drawings show container assembly 20 in a closed and sealed condition. The assembly includes a drum 22 which is of tubular configuration closed at the bottom 23 and open at the upper end. The drum is of the industrial type and may be fabricated from plastic, metal, or fiber and may be lined where desired or necessary. The drum may be circular, square with straight or rounded sides with rounded corners. The upper end includes a top chime construction in which the upper rim is in the form of an inwardly curled bead 24 having an inner end 26 both embraced and surrounded by a steel chime 28 which conforms in configuration to the bead 24 and terminates in an inwardly and upwardly extending flange 30 around and under the curl and bead end 26.

Mounted on the upper chime construction 23 of drum 22 and forming an integral part thereof is the sealing gasket 32. The gasket is of a flexible plastic material such as polyethlene, or any other suitable resinous material, and is formed into an annular ring prior to assembly. The ring may be formed by cutting a continuous length of the material and then adhering or connecting the ends in a conventional fashion such as by fusion welding at the plants where the containers are manufactured. The gasket material may be conveniently and economically extruded from a plastic forming die in a continuous strip for form packaging in rolls for delivery to such plants.

The details of this strip are shown in FIG. 4 including a plurality of longitudinal, adjacent, parallel ribs 34 extending from one surface of the strip. The ribs are triangular in configuration so as to terminate in flexible points 36. Of course, the ribs assume other forms and shape to effectuate the intended seal. One longitudinal edge of the strip is formed with a flange 38 which extends laterally from both sides of the strip. The other lateral edge of the strip contains a longitudinally extending bead 40. Flange 38 and bead 40 cooperate in mounting and securing gasket 32 in place on the container.

In the manufacture of the container and particularly during the formation of the top chime 23 the gasket ring flanged end 38 seats in the space between the chime strip end 30 and the curled bead end 26 and is held securely therein in a liquid tight-air tight configuration.

The gasket 32 is then stretched over the top of the container chime 28 and down under the outside of the chime. The nature of the flexible plastic strip is such that the outer beaded edge 40 tends to snap around and under the beaded portion of the chime construction 23. The bead 40 prevents slippage of the outer portion of the gasket 32 back down inside of the drum. When the locking ring 42 is applied, it contacts the bead 40 it snugly tucks the gasket strip 32 under the top beaded end of the top chime 23 of the container and smooths everything out as the rim is contracted and as the cover or lid 44 is pulled down against the upper portion of the protective gasket 32.

This brings us to the remaining components in the sealed container assembly. They include a lid 44 having a curved outer circumferentially extending edge portion generally conforming to the upper curved bead edge of the top chime 23 with the sealing strip 32 interposed therebetween. The cover 44 may be formed from a plastic material, metal or fiber which may be lined. An annular locking ring 42 of a conventional nature is then applied to lock cover 44 to the container. When this action occurs, the ribs 34 are engaged by the cover 44 and deformed forming a tight seal between the inner surface of the cover and the upper rim of the top chime construction 23. Furthermore, the locking ring 42 has its lower edge 46 in engagement with bead 40 to retain the strip 32 in its desired fixed and sealing position. In this manner all of the components are tightly interengaged and the container is in a tight sealed condition preventing leakage of liquids or other fluid materials within the container.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. A container comprising: a tubular side wall having an upper end and a bottom end, means closing the bottom end and a top chime construction at the upper end including an inwardly curled bead and a chime strip surrounding the upper end of the container and following the configuration of the bead, the container adapted to receive a cover having a circumferentially extending peripheral edge adapted to conform to the top bead with the cover adapted to be secured across the upper open end of the container by a locking ring assembly, a protective gasket associated with the top chime construction of the container for cooperating in providing a seal between the upper end of the container and the cover, the gasket comprising an annual flexible planar strip in conformation with surfaces of the top chime construction of the container, retention means on the strip in engagement with surfaces of the top chime construction and disposed in the inwardly curled bead to hold the strip in position on the chime, said retention means being in the form of a laterally extending flange extending beyond the surface of the strip on both sides thereof, sealing means on the strip for engaging with the cover applied to the container for providing a seal between the container and the cover, and the strip having sufficient flex to extend around the curl to the inside thereof to be engaged by the inner end portion of the chime and held in position and to be stretched over the chime portion surrounding the head of the container and to snap around and under the bead so as to be mounted on the container.

2. The invention in accordance with claim 1, wherein the gasket is of a plastic material.

3. The invention in accordance with claim 2 wherein the plastic material is polyethelene.

4. The invention in accordance with claim 1 wherein the sealing means includes projecting ribs.

5. The invention in accordance with claim 4 wherein the projecting ribs are in the form of a plurality of parallel adjacent triangular shaped ribs terminating in an apex distal from the surface of the remainder of the strip from which the ribs project, the ribs projecting longitudinally around the circumference of the strip and being intermediate the lateral sides of the strip so as to be in position for engagement with the inner surface of a lid applied to the container on which the strip is mounted.

6. The invention in accordance with claim 1 wherein the outer lateral edge of the strip contains a bead about its entire circumference adapted to be positioned beneath the beaded portion of the top chime construction when the strip is mounted thereon and to be engaged by a locking ring so as to prevent the strip from slipping inwardly of the container when mounted thereon.

7. A protective gasket for association with the top chime construction of a container which has an inwardly curled upper bead and surrounding chime, the gasket cooperating in providing a seal between the top rim of the container and its cover, the gasket comprising:

an annular flexible strip adapted to conform to surfaces of the top chime construction of the container;

retention means on the strip to cooperate with surfaces of the top chime construction of the container to hold the strip in position on the chime, said retention means including an edge of the strip adapted to extend inwardly of the container when the strip is mounted thereon and having the form of a laterally extending flange extending beyond the surface of the strip on both sides thereof, the flange adapted to be captured by portions of the chime of the container so as to prevent the strip from being moved out of the container;

sealing means on the strip including projecting ribs in the form of a plurality of parallel adjacent triangular shaped ribs terminating in an apex distal from the surface of the remainder of the strip from which the ribs project, the ribs projecting longitudinally around the circumference of the strip and being intermediate the lateral sides of the strip so as to be in position for engagement with the inner surface of a cover applied to the container on which the strip is mounted and providing a seal between the container and cover;

a bead formed on the outer lateral edge of the strip about its entire circumference adapted to be positioned beneath the beaded portion of the top chime construction when the strip is mounted thereon and to be engaged by a locking ring so as to prevent the strip from slipping inwardly of the container when mounted thereon; and the strip having sufficient flex to extend around the curl to the inside thereof to be engaged by the inner end portion of the chime and held in position and to be stretched over the chime portion surrounding the head of the container and to snap around and under the beaded portion so as to be mounted on the container.

8. The invention in accordance with claim 7 wherein the gasket is of a plastic material.

9. The invention in accordance with claim 8 wherein the plastic material is polyethelene.

* * * * *